US006700525B2

(12) United States Patent
Gustafsson

(10) Patent No.: US 6,700,525 B2
(45) Date of Patent: Mar. 2, 2004

(54) RADIATION ABSORBER

(75) Inventor: Nils Gustafsson, Linghem (SE)

(73) Assignee: Totalforsvarets Försknings Institut, Stockholm (SE)

( * ) Notice: Subject to any disclaimer, the term of this patent is extended or adjusted under 35 U.S.C. 154(b) by 0 days.

(21) Appl. No.: 10/257,975

(22) PCT Filed: Apr. 27, 2001

(86) PCT No.: PCT/SE01/00926

§ 371 (c)(1),
(2), (4) Date: Oct. 28, 2002

(87) PCT Pub. No.: WO01/84672

PCT Pub. Date: Nov. 8, 2001

(65) Prior Publication Data

US 2003/0148133 A1 Aug. 7, 2003

(30) Foreign Application Priority Data

Apr. 28, 2000 (SE) ..... 0001565

(51) Int. Cl.[7] ..... H01Q 17/00
(52) U.S. Cl. ..... 342/1
(58) Field of Search ..... 342/1, 2, 3, 4

(56) References Cited

U.S. PATENT DOCUMENTS 3,680,107 A * 7/1972 Meinke et al. ..... 342/1
4,012,738 A * 3/1977 Wright ..... 342/1
4,038,660 A 7/1977 Connolly et al. ..... 343/18 A
5,003,311 A 3/1991 Roth et al. ..... 342/4
5,323,160 A * 6/1994 Kim et al. ..... 342/1
5,325,094 A 6/1994 Broderick et al. ..... 342/1
5,537,116 A 7/1996 Ishino et al. ..... 342/1
5,576,710 A 11/1996 Broderick et al. ..... 342/1

FOREIGN PATENT DOCUMENTS

SE 463 389 11/1990

OTHER PUBLICATIONS

Proceedings of the second international conference on electromagnetics in aerospace applications; Bergquist; A frequency–selective reflector; 1991; pp. 83–85.

* cited by examiner

*Primary Examiner*—Thomas H. Tarcza
*Assistant Examiner*—Brian Andrea
(74) *Attorney, Agent, or Firm*—Jacobson Holman PLLC

(57) ABSTRACT

A radiation absorber which is placed on the irradiated side of a conductive surface (L) whose surface resistance <0.1 Ω/square. The radiation absorber comprises three layers, which from said conductive surface outwards consist of a first dielectric (B1), a resistive layer (C1) and a second dielectric (B2). The surface resistance of the resistive layer is 225 Ω/square±25% and the thickness of the layer without a possible carrier <0.2 mm. The dielectric constant $\epsilon$=2±25% for the two dielectric layers and their thicknesses are of the same order of magnitude. The total thickness $d_A$ of the absorber, with all the layers included, is selected according to the formula $$d_A = \frac{1}{\sqrt{\varepsilon}} \cdot \frac{\lambda}{4}$$

in order to give an absorption peak at a desired wavelength $\lambda$ expressed in meters.

9 Claims, 1 Drawing Sheet

RADIATION ABSORBER

This is a nationalization of PCT/SE01/00926 filed Apr. 27, 2001 and published in English.

The present invention relates to a radiation absorber, especially an integrated radiation absorber. Absorbers for the VHF, UHF and microwave as well as millimeter wave range are used to reduce the retroreflections of an object when illuminated by illuminating radiation. In connection with radar, the radar cross section of an object is referred to, which is the apparent extent of an object when illuminated by a radar which is satellite-borne, airborne, sea-borne or arranged on ground level. In many cases it is desirable to reduce the radar cross section. Absorbers are also used indoors in measuring rooms or in other places where undesirable electromagnetic radiation is to be reduced.

Absorbers can be of the resonant type or of the non-resonant type. Known resonant absorbers, such as so-called single foil layer absorbers, to which the present absorber belongs, usually have good radiation-absorbing capacity for radiation within a certain narrow frequency range. However, it is a great advantage if a radiation absorber can act within a great frequency range which should be easily calculatable and adaptable to the application at issue and the desiderata involved.

In many applications, including military applications, it is also most important to use absorbers which are shockproof, weatherproof and environmentally resistant. Besides it is advantageous if they can be integrated into the structure of an object and contribute to the load-carrying capacity thereof. Other desirable properties are low weight, low price and the possibility of being manufactured, without complicated special engineering, by the manufacturer of the object whose surface is to be coated. It should be possible to apply them on previously manufactured objects, which usually requires the weight of the absorber to be low.

The present invention solves all the problems described and provides an integrated radiation absorber with a wide working frequency range by being designed in the manner as is evident from the independent claim. Advantageous embodiments of the invention are defined in the remaining claims.

Figure 1:
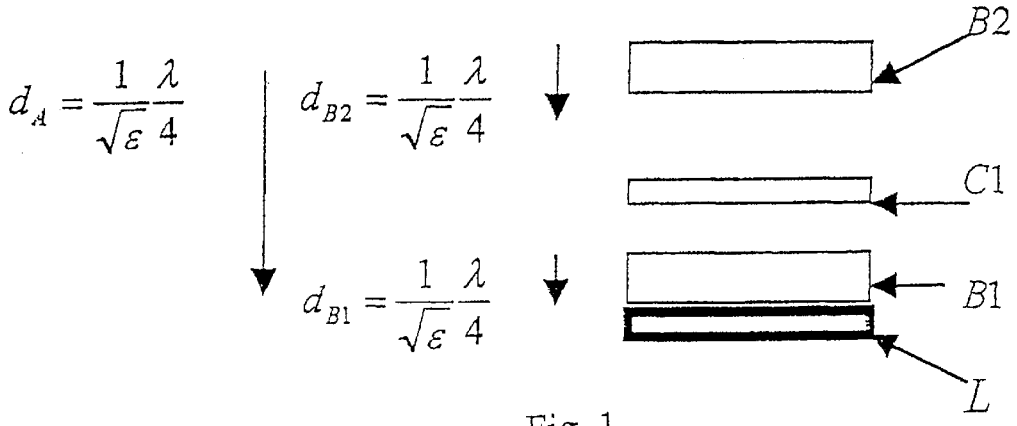
Figure 2:
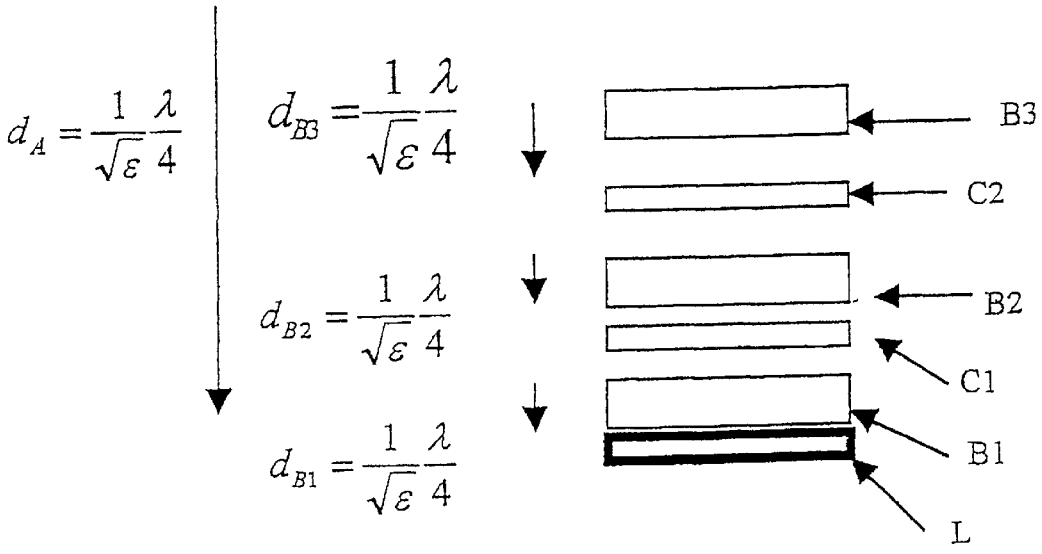

The invention will now be described in more detail with reference to the accompanying drawing, in which FIG. 1 shows the fundamental composition of a radiation absorber according to the invention, and FIG. 2 shows the fundamental composition of a radiation absorber according to a second embodiment of the invention.

By modifying a so-called single foil layer absorber, i.e. a foil with a resistive layer between two dielectrics, and giving the layer specific new values of dielectric constants, resistivities and thicknesses, it has been found possible to create a new absorber which has completely new absorbing properties compared with prior-art absorbers. In spite of a long-felt need for these properties, only the present invention has solved the problem.

In a basic embodiment of the invention, the radiation absorber is composed of three layers, see FIG. 1. On the outside, against incident radiation, there is a dielectric layer B2 with a low dielectric constant, about $\epsilon=2$, in order to give a great bandwidth. The surface reflection from the actual material will thus be very low.

Then follows a resistive layer C1 with the surface resistance about 225 Ω/square. Under the resistive layer there is one more dielectric layer B1 with about $\epsilon=2$. For the absorption material to work as absorption material, it must be terminated (supported) with an electrically conductive layer L, such as a metal sheet or a carbon fibre layer with low resistivity, i.e. <0.1 Ω/square. The inner conductive layer is in many cases the structure whose reflectivity is to decrease, such as the hull of a military ship.

The values of the dielectric constant and the surface resistance can be allowed to vary ±25% at the most. $\epsilon=2\pm25\%$ means that $\epsilon$ should be between 1.5 and 2.5. 225 Ω/square±25% means that the surface resistance should be between 168.75 and 281.25 Ω/square. For improved function, they should be within the indicated target values ±10%, which is equivalent to $\epsilon$ being between 1.8 and 2.2 and the surface resistance between 202.5 and 247.5 Ω/square.

The thickness of the layers is crucial to where absorption peaks arise within the usable working frequency range. The resistive layer C1 should always be very thin without a possible carrier, <0.2 mm. The total thickness $d_A$ of the two dielectric layers B1 and B2 and the resistive layer C1 (a possible carrier included) determines the absorption maximum of the lowest frequency range and is calculated as follows $$d_A = \frac{1}{\sqrt{\varepsilon}} \cdot \frac{\lambda}{4},$$

where λ is the wavelength in meters for the desired absorption peak, in order to obtain the correct thickness.

The incident field passes the two dielectric layers without any considerable losses. It is only in the resistive layer C1 that the electric field is significantly reduced, i.e. great losses arise. The field is reflected against the electrically conductive layer L and will be in phase opposition to the incoming field which is thus additionally reduced.

The corresponding effect arises in each dielectric layer separately. The thickness of the thickest of the dielectric layers included thus determines the absorption maximum of the next higher frequency range and is calculated similarly to the thickness of the entire absorbent. The best function is achieved if the thickest dielectric layer is placed on the outside although the absorber also functions when arranged in reverse order. Here the outer layer B2 is assumed to be the thickest and its thickness is calculated as follows $$d_{B2} = \frac{1}{\sqrt{\varepsilon}} \cdot \frac{\lambda}{4}.$$

If the inner dielectric layer B1 is selected to have the same thickness as the outer layer, a symmetry is obtained, which is positive in the sense that it results in a deeper absorption minimum. Each dielectric can have a thickness of between 1 and 50 mm for possible applications.

In order to increase the absorption bandwidth, additional layers can be added to those indicated so far, see FIG. 2. On the outside of the outer of the two dielectric layers used so far, use is then made of a resistive layer C2 of essentially the same type as the resistive layer stated so far, except that its surface resistance should be about 330 Ω/square. With the same degree of variation as applied so far, ±25%, this means that the resistance should be between 247.5 and 412.5 Ω/square. It is still better, as stated above, to be within ±10%, which means that the surface resistance should be between 297 and 363 Ω/square. On the outside there is again a dielectric B3 of the same type as the other dielectrics, i.e. with $\epsilon$ about 2.

Like in the above case involving two dielectric layers and one resistive layer, the total thickness $d_A$ of the three dielectric layer and the two resistive layers (a possible carrier included) determines the absorption maximum of the lowest frequency range and is calculated as follows $$d_A = \frac{1}{\sqrt{\varepsilon}} \cdot \frac{\lambda}{4}.$$

Like in the case above, the thickness of the thickest of the dielectric layers included determines the absorption maximum of the next higher frequency range and is calculated as described above. If all dielectric layers are selected to have the same thickness as the first, a symmetry is obtained, which is positive in the sense that it results in symmetric absorption properties while at the same time the bandwidth is increased. However, the other dielectric layers can also be selected in such manner that for each layer a specific absorption peak is obtained at a desired wavelength. The optimal function is obtained if the thickness of the dielectric layers decreases from outside inwards.

The resistive layers can be made of conductive polymers which have been doped to about 225 and 330 Ω/square respectively. These values are selected to be about 10% higher than the theoretically optimal values since this type of polymer foil has a negative temperature coefficient.

As dielectric, it is possible to chose a polyester fabric, for example as sold under the trademarks Trevira, Firett coremat and U-pica coremat, polytetrafluoroethylene which is sold under the trademark Teflon, or aramid which is sold under the trademark Kevlar. By using a suitable fabric of, for instance, polyester as dielectric, the absorber can contribute to the load-carrying capacity of the total structure.

Polyester plastic has been used as adhesive for the layers included. It is important for the plastic to contain rubber, on the one hand to prevent moisture from penetrating and impairing the absorption properties and, on the other hand, to obtain a low $\epsilon$, since rubber has an $\epsilon$ which is about 2.

The products that have been used in the manufacture are the vinylester resins DOW Chem 80–84 and Dion 95–00. A number of tests have been carried out and measured with a good absorption result compared with theoretical calculations. Both are equivalent from the user's viewpoint in various temperature surroundings from −70° to +70°.

What is claimed is:

1. A radiation absorber which is placed on the irradiated side of a conductive surface (L) whose surface resistance <0.1 Ω/square, said radiation absorber comprising three layers, which from said conductive surface outwards consist of a first dielectric (B1), a resistive layer (C1) and a second dielectric (B2), characterised in that for the resistive layer the surface resistance is 225 Ω/square ±25% and the thickness of the layer without a possible carrier <0.2 mm, that for the two dielectric layers the dielectric constant $\epsilon$=2±25%, that the thicknesses of the two dielectric layers are of the same order of magnitude and that the total thickness $d_A$ of the radiation absorber, with all the layers included, is selected according to the formula $$d_A = \frac{1}{\sqrt{\varepsilon}} \cdot \frac{\lambda}{4}$$

in order to give an absorption peak at a desired wavelength λ expressed in meters.

2. A radiation absorber as claimed in claim 1, characterised in that on the second dielectric layer (B2) there is arranged a second resistive layer (C2) with the surface resistance 330 Ω/square±25% and on this a third dielectric layer (B3) with the dielectric constant $\epsilon$=2±25% and a thickness of the same order of magnitude as the first and the second dielectric layer, and that the total thickness $d_A$ of the radiation absorber, with all the layers included, is still selected according to the formula $$d_A = \frac{1}{\sqrt{\varepsilon}} \cdot \frac{\lambda}{4}$$

in order to give an absorption peak at a desired wavelength λ expressed in meters.

3. A radiation absorber as claimed in claim 1, characterised in that the thickness of the thickest of the dielectric layers included (B1, B2, B3) is calculated according to $$d_B = \frac{1}{\sqrt{\varepsilon}} \cdot \frac{\lambda}{4}$$

in order to give a second absorption peak at a second higher wavelength λ expressed in meters.

4. A radiation absorber as claimed in claim 3, characterised in that the thickness of at least one further dielectric layer (B1, B2, B3) is calculated according to $$d_B = \frac{1}{\sqrt{\varepsilon}} \cdot \frac{\lambda}{4}$$

in order to give an absorption peak at a higher wavelength λ expressed in meters.

5. A radiation absorber as claimed in claim 3, characterised in that each dielectric layer (B2, B3) which is positioned outside another dielectric layer has a thickness which is greater than or equal to the thickness of the next inwardly situated dielectric layer.

6. A radiation absorber as claimed in claim 1, characterised in that the thickness of the dielectric layers included is the same.

7. A radiation absorber as claimed in claim 1, characterised in that the dielectric layers comprise a polyester fabric.

8. A radiation absorber as claimed in claim 1, characterised in that the layers included are glued together with vinylester resin.

9. A radiation absorber as claimed in claim 1, characterised in that the conductive layer (L) is made of carbon fiber reinforced plastic.

* * * * *